US006019226A

United States Patent [19]

Zajdlik et al.

[11] Patent Number: 6,019,226

[45] Date of Patent: Feb. 1, 2000

[54] DEMOUNTABLE PALLETIZED CONTAINER

[75] Inventors: Larry K. Zajdlik, LaSalle, Canada; Thomas N. Potcova, Monroe, Mich.

[73] Assignee: Ace Packaging Systems, Inc., Monroe, Mich.

[21] Appl. No.: 09/138,418

[22] Filed: Aug. 24, 1998

[51] Int. Cl.[7] ..... B65D 19/00

[52] U.S. Cl. ..... 206/600; 108/55.1; 220/4.34

[58] Field of Search ..... 206/598, 599, 206/596, 600, 586, 521; 220/4.28, 4.33, 4.34, 4.31, 4.32, 6

[56] References Cited

U.S. PATENT DOCUMENTS

| | | | |
|---|---|---|---|
| 1,828,088 | 10/1931 | Robinson | 220/4.34 |
| 3,572,535 | 3/1971 | Kinzie | 220/4.33 |
| 3,819,079 | 6/1974 | Levens | 220/4.33 |
| 4,960,223 | 10/1990 | Chiang et al. | 220/6 |
| 5,110,037 | 5/1992 | Pieritz, Sr. | 206/386 |
| 5,507,237 | 4/1996 | Barrow et al. | 108/55.1 |
| 5,609,111 | 3/1997 | Hasegawa et al. | 108/55.1 |
| 5,826,721 | 10/1998 | Fujimoto et al. | 206/389 |
| 5,855,291 | 1/1999 | Ingle | 220/6 |

*Primary Examiner*—Paul T. Sewell
*Assistant Examiner*—Nhan Lam
*Attorney, Agent, or Firm*—Brinks Hofer Gilson & Lione

[57] ABSTRACT

A multi-component demountable palletized container includes a pallet bottom, four sidewall components which may be readily assembled with rods and disassembled and a top. Each of the sidewalls include a pair of horizontal and a pair of vertical members that are overlapped at their ends and are secured together. An inner cardboard panel is secured to the inside of the sidewalls and closes off the space between the members. The vertical members define grooves or channels which receive assembly straps or clips having hooked ends which align to define a corner axis and which receive elongate rods.

22 Claims, 6 Drawing Sheets

102
10
18
94
90
92
16
72
90
66
64
94
90
92
72
64
16
68
14
52
66
14
68
58
58
54
56
42
38
56
12
36
22
32
12
34
44
34
32
24
26
38
22
28
26
24
28

DEMOUNTABLE PALLETIZED CONTAINER

BACKGROUND OF THE INVENTION

The invention relates generally to demountable containers and more specifically to a palletized container that can be readily assembled and disassembled and that includes a pallet bottom, four sidewall components and a top or cover.

Parts shipment from one manufacturer to another, in the past, required little in the way of sophisticated containers. Oftentimes castings or other bulk parts would simply be shipped in a rigid container having a volume appropriate to the density of the parts such that the container, when filled, would not have an unreasonable weight. Frequently, if the parts were of relatively large size, the container would include customized support or separating structures to isolate one part from adjacent parts and minimize damage during shipment.

A significant drawback of all such rigid shipping containers is their deadhead return to the manufacturing facility, that is, their return in an empty state to be refilled. Such deadheading was and is an inherent problem of any rigid, dedicated container utilized to ship parts from one location to another.

This inefficient use of containers has prompted much development effort in the field of both collapsible and recyclable containers. Collapsible containers are broadly that class of containers which may be assembled for parts shipment and disassembled for return. One example of such a container has a rigid bottom and sidewalls having vertical stakes which are received within complementarily sized and configured openings in the bottom. Cardboard containers having releasable locking tabs or corners have also been developed. They may be opened into a box in which the tabs and corners lock to maintain the shape of the container. The tabs and corners may then be released and the box folded flat for return shipment.

Recyclable containers are simply those in which the material from which the container is fabricated is relatively inexpensive and uniform throughout the container so that it may be, for example, ground up and reused in a similar or other form after its one-way trip from the manufacturer to the customer. These and similar solutions to the problem of one-way use of containers have not been entirely satisfactory. Thus, improvements in containers which specifically address the one-way nature of many part shipments are highly desirable.

SUMMARY OF THE INVENTION

A multi-component demountable palletized container includes a pallet bottom, four sidewall components which may be readily assembled with rods and disassembled and a top. Each of the sidewalls include a pair of horizontal and a pair of vertical members that are overlapped at their ends and secured together. An inner cardboard panel is secured to the inside of the sidewalls and closes off the space between the members. The vertical members define grooves or channels which receive assembly straps or clips having hooked ends which align to define a corner axis and which receive elongate rods.

The demountable palletized container can thus be readily assembled by placement of the four sidewalls on the pallet bottom, the insertion of the four elongate rods into the overlapping hooked ends of the corner straps and installation of the top to cover and protect the contents of the container. Disassembly is equally rapid and involves removal of the top, if not already removed, removal of the four elongate rods by pulling them up and then separation of the four sidewalls from one another and the pallet bottom. The components may then be conveniently stacked on the pallet bottom for return and re-use.

Thus it is an object of the present invention to provide a demountable, multi-component palletized container.

It is a further object of the present invention to provide a demountable, multi-component palletized container which may be readily assembled and disassembled for return and re-use.

It is a still further object of the present invention to provide a demountable, multi-component palletized container having a bottom panel, four separate sidewalls and a top.

It is a still further object of the present invention to provide a demountable, multi-component palletized container wherein adjacent sidewall ends includes clips and elongate rods secure adjacent hooks and sidewalls together.

Further objects and advantages of the present invention will become apparent by reference to the following description of the preferred embodiment and appended drawings wherein like reference numbers refer to the same element, component or feature.

DESCRIPTION OF THE PREFERRED EMBODIMENT

Figure 1:
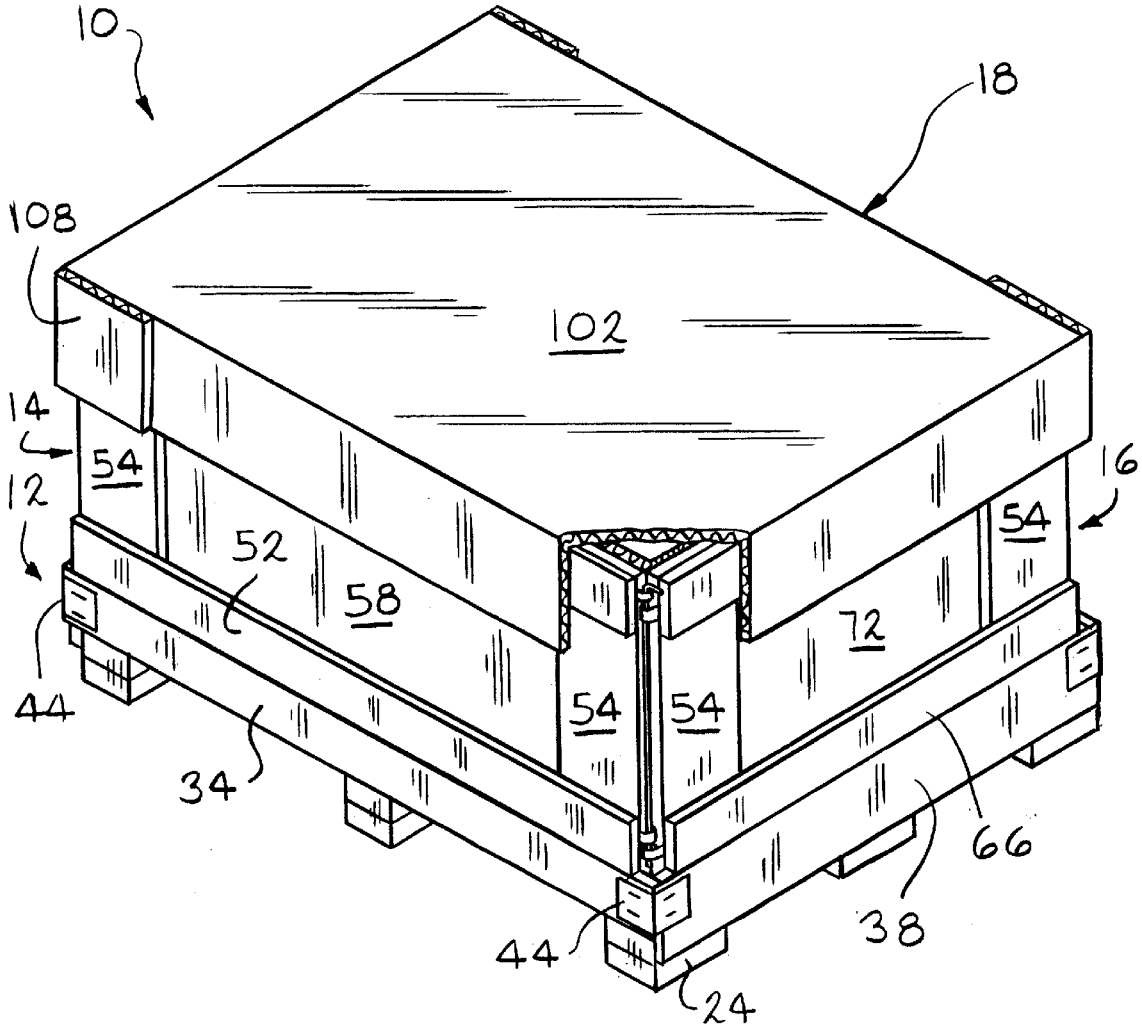
FIG. 1 is a perspective view of a demountable palletized container according to the present invention.
Figure 2:
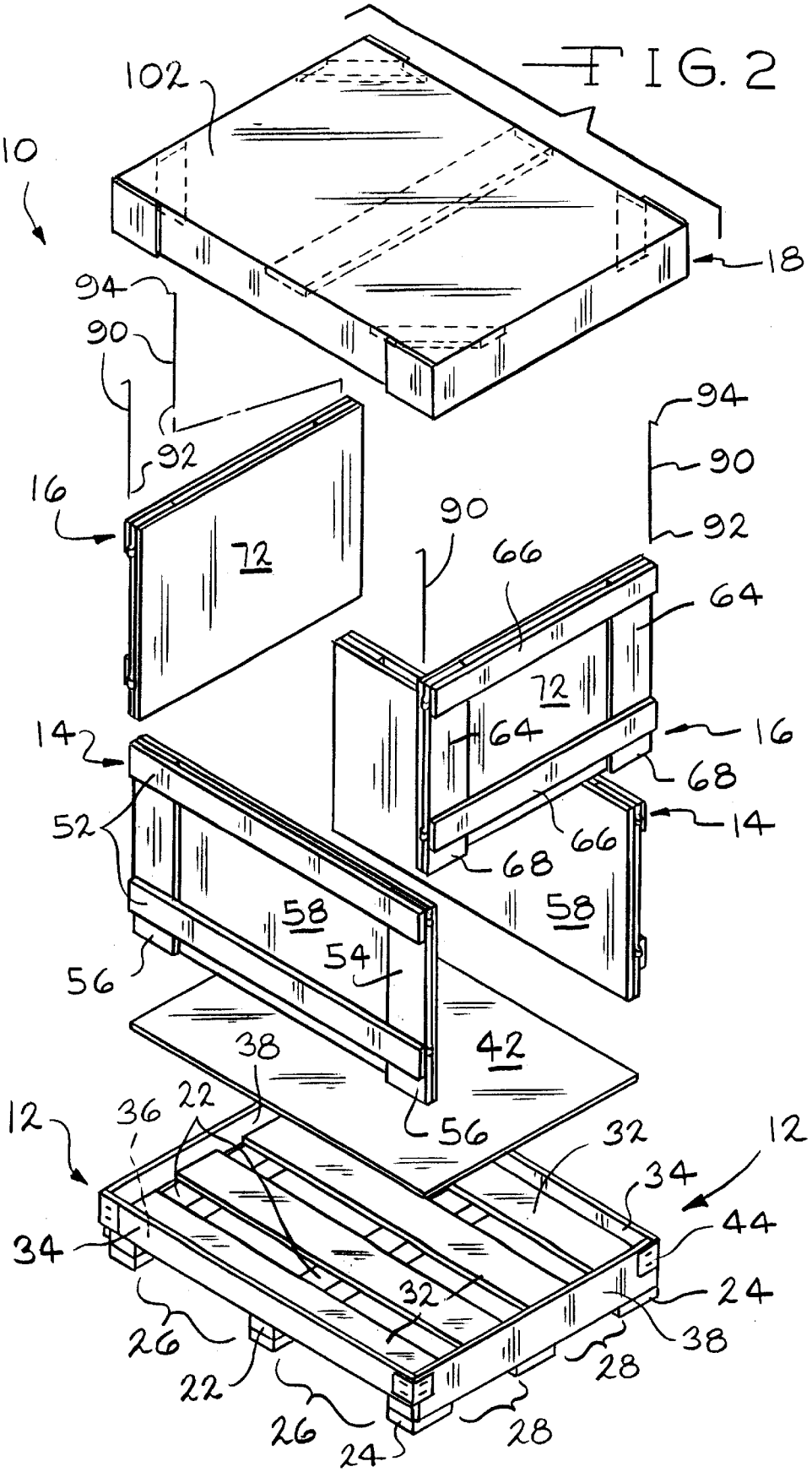
FIG. 2 is an exploded, perspective view of a demountable palletized container according to the present invention.

Referring now to FIGS. 1 and 2, a demountable palletized container according to the present invention is illustrated and designated by the reference number 10. The demountable palletized container 10 includes a pallet assembly 12, a first pair of opposed sidewall assemblies 14, a second pair of opposed sidewall assemblies 16 extending between the ends of the first pair of sidewall assemblies 14 and a top or tray assembly 18.

Figure 3:
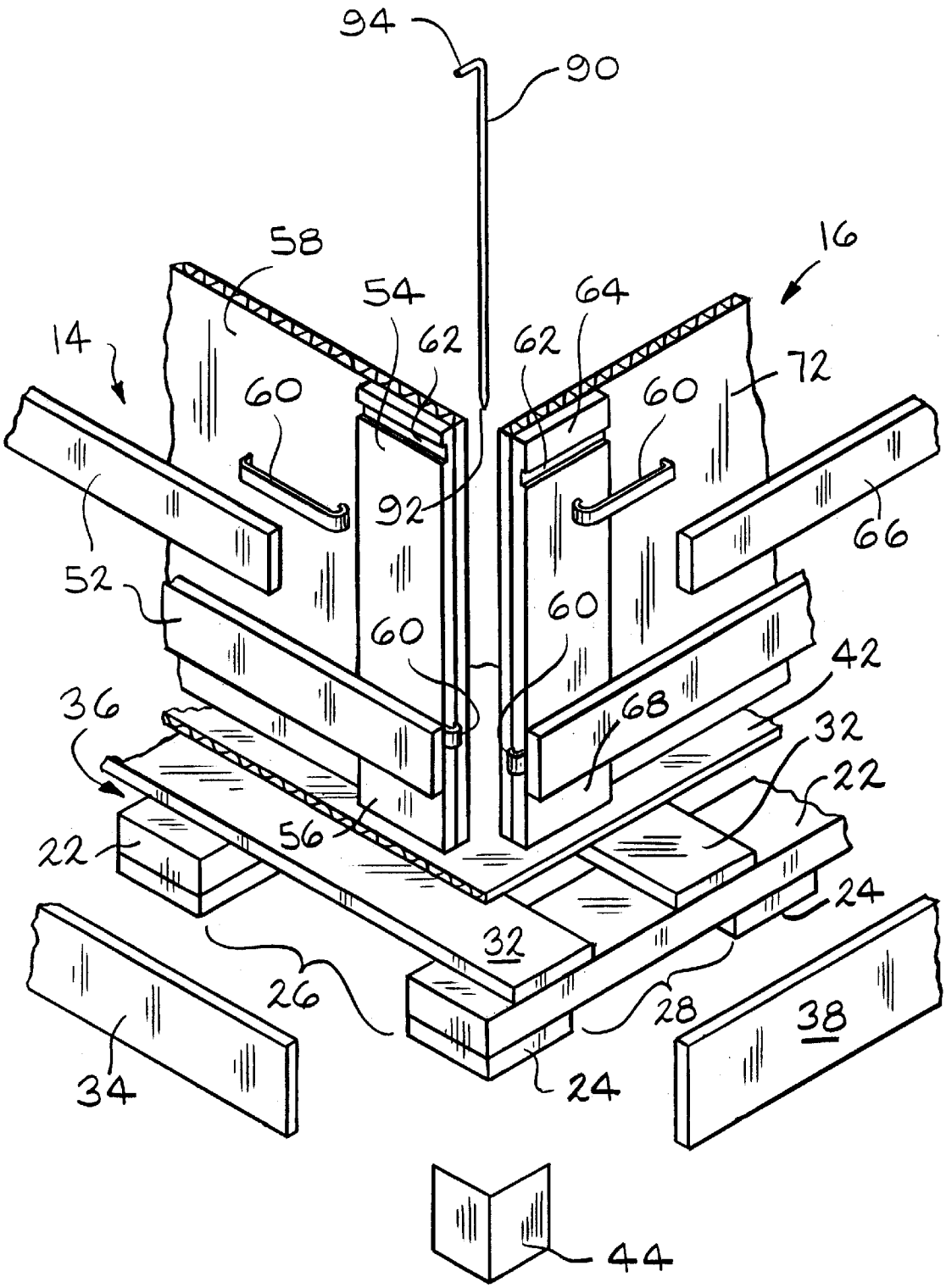
FIG. 3 is an exploded, perspective view of a corner portion of a demountable palletized container according to the present invention.

Turning first to the pallet assembly 12 and FIGS. 2 and 3, it includes a plurality, preferably three lower transverse members 22 which extend the full distance from the front to the rear of the pallet assembly 12. Preferably disposed at three locations along the length of each of the transverse members 22 is a skid or shoe 24 which raises the transverse members a small distance, typically ½ inch (12.7 mm) to ¾ inches (19 mm) above a supporting surface such as a floor. Both the spacing of the transverse members 22 and of the skids or shoes 24 define transverse regions 26 and longitudinal regions 28 which are adapted to receive the forks of a forklift truck (not illustrated). Secured to the upper surfaces of the transverse members 22 are a plurality, preferably four, longitudinal members 32 which extend the full distance between the outer edges of the outer transverse members 22. The frontmost and rearmost of the longitudinal members 32 are set back or recessed a distance of preferably about ¾ inch (19 mm) from the ends of the transverse members 22. A pair of vertically disposed longitudinally extending face plates 34 preferably extend two to three inches (51 mm to 76 mm) above the surface of the longitudinal members 32. The forwardmost and rearwardmost edges of the longitudinal members 32 and the adjacent longitudinal face plates 34 define a pair of longitudinally extending recesses or slots 36. A pair of vertically disposed, transversely oriented end plates 38 extend from the front to the rear of the pallet assembly 12 and join and are flush along their top surfaces with the longitudinal end plates 36. A deck pad 42 of corrugated cardboard is positioned upon the upper surfaces of the longitudinal members 32 and closes off the spaces between the longitudinal members 32. The deck pad 42 extends longitudinally between the transverse end plates 38 and transversely from the front edge of the forward longitudinal member 32 to the rear edge of the rear longitudinal member 32, thereby also defining the slots 36. The deck pad 42 may be secured to the longitudinal members 32 by stitching or a suitable adhesive. Preferably, a fiber or metal bumper pad 44 is secured to the pallet assembly 12 at each outer corner. The bumper pads 44 absorb shocks and insults to the pallet assembly 12 and extends its service life.

Turning then to the first pair of longitudinal or sidewall assemblies 14, each includes a pair of upright or horizontal members 52 and a pair of vertical members 54. The vertical members 54 are disposed behind or toward the interior of the container 10 relative to the pair of horizontal members 52. While the upper ends of the vertical members 54 are flush with the upper edge of the upper horizontal member 52, the lower portions of the pair of vertical members 54 extend beyond the lower edge of the lower horizontal member 52 several inches and define stakes or retainers 56. These stakes or retainers 56 are received within the slots or recesses 36 adjacent the longitudinal face plates 34. On the inner faces of the vertical members 54 is disposed and secured a cardboard pad or panel 58. The cardboard panel 58 is somewhat resilient relative to the wood of the other pallet members and thus provides a modicum of padding for the parts or material disposed within the container 10. The cardboard panel 58 also closes off the space between the pair of horizontal members 52 and the pair of vertical members 54 thereby making the container 10 suitable for small parts and components. At each end of each of the pair of longitudinal members 52 is located an assembly clip 60. The assembly clips 60 are received within horizontal channels 62 preferably routed in the horizontal members 52 of the first sidewall assemblies 14. The assembly clips 60 will be described in more detail below.

The second pair of opposed sidewall assemblies 16 are similar to the first pair of sidewall assemblies 14. If the pallet assembly 12 defines a rectangular shape, they will define the shorter sidewalls. If the pallet assembly 12 is square, they will be the same length as the first pair of sidewall assemblies 14 although there will also be other minor differences. Each of the second pair of sidewall assemblies 16 includes a pair of inner, upright or vertical members 64 whose outer longitudinal or edges define the length of each of the second pair of sidewall assemblies 16. Flush with the top of the vertical members 54 are a pair of outer, horizontal members 66. While the upper edges of the upper horizontal members 66 are flush with the upper ends of the vertical members 64, the lower portions of the pair of vertical members 64 extend beyond the lower edge of the lower horizontal member 66 one or two inches and define stakes or retainers 68. On the inner faces of the vertical members on each of the pair of sidewall assemblies 16 is disposed and secured a cardboard pad or panel 72. Like the cardboard panel 58, the cardboard panel 72 is somewhat resilient and thus provides a modicum of padding for the material contained within the container 10 and also closes off the space between the pair of vertical members 64 and the pair of horizontal members 66. At each end of each of the pair of horizontal members 66 is located an assembly clip 60.

Figure 4:
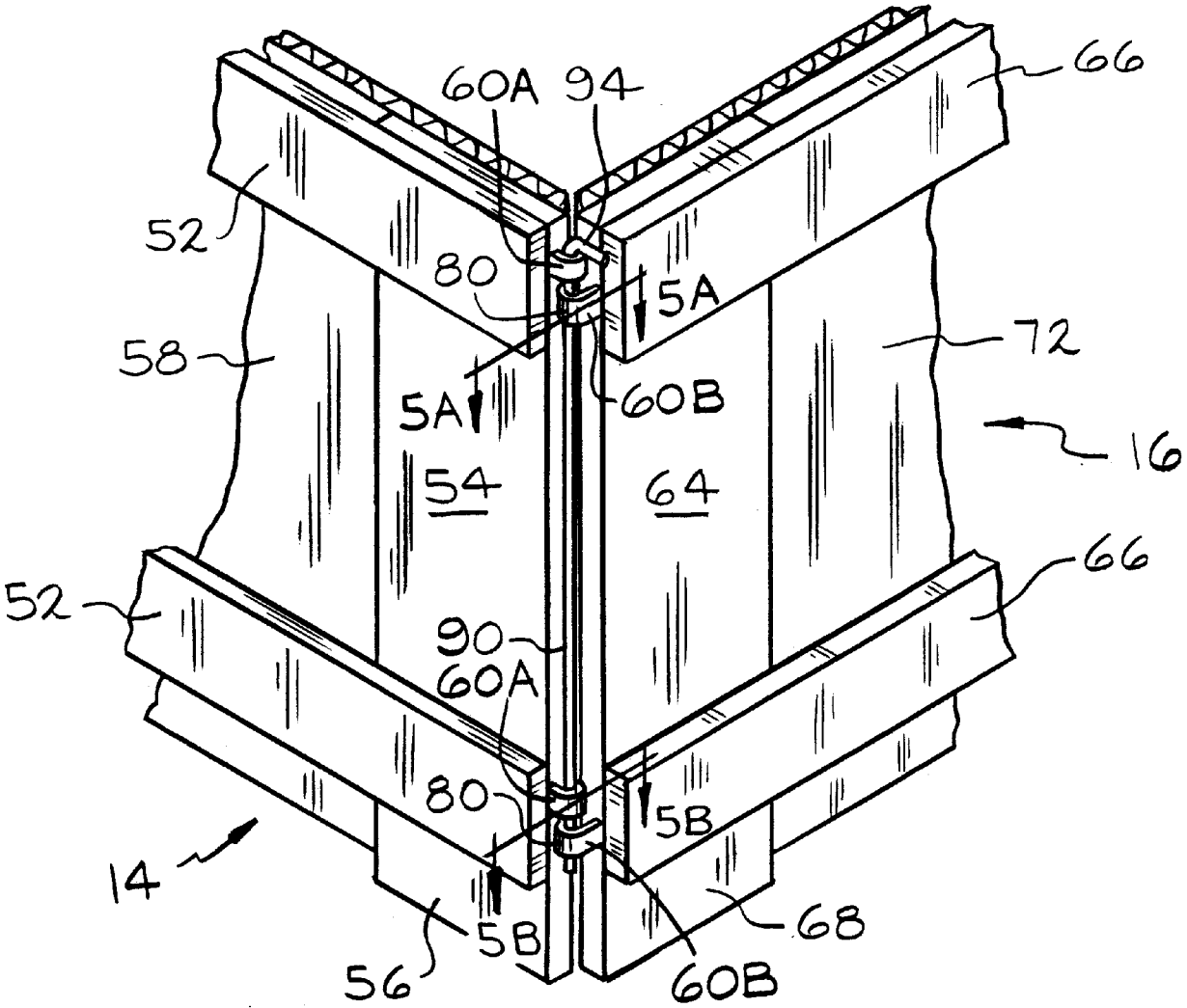
FIG. 4 is an assembled, perspective view of a corner of a demountable palletized container according to the present invention.
Figure 5A:
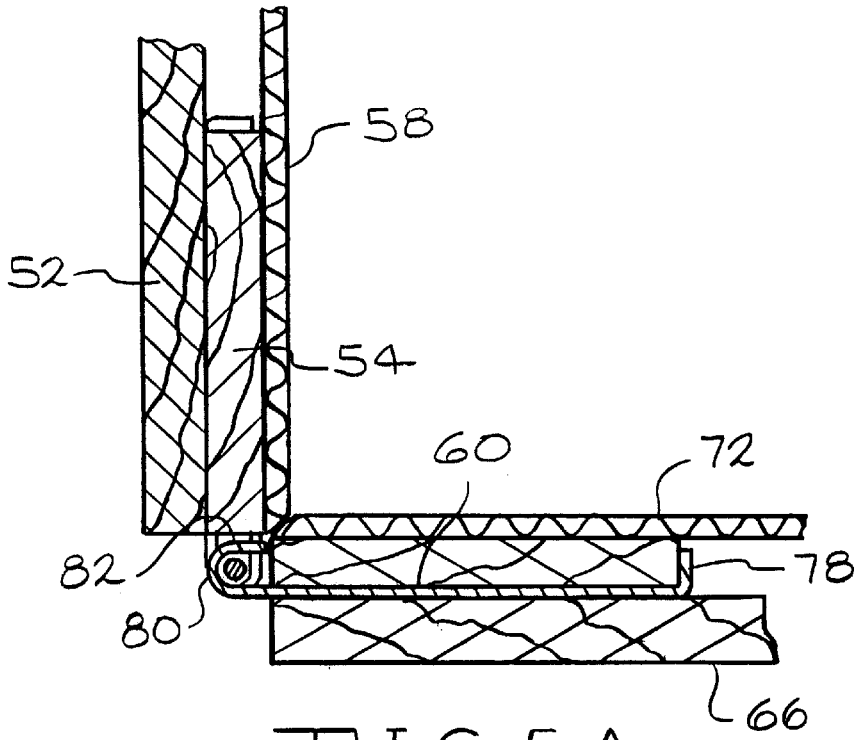
FIG. 5 is a fragmentary, sectional view of a sidewall component and an assembly clip taken along line 5—5 of FIG. 4.
Figure 5B:
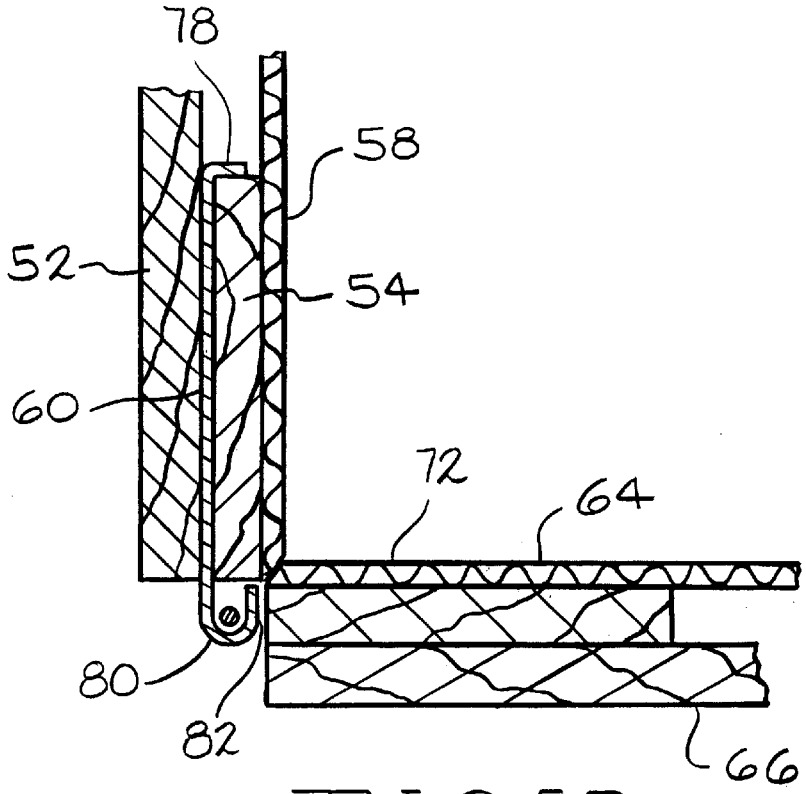

Referring now to FIGS. 3, 4 and 5, the corner attachment assemblies 18 will be described. At each corner of the palletized container 10 and thus at both ends of the first pair of opposed sidewall assemblies 14 and both ends of the second pair of opposed sidewall assemblies 16 are disposed assembly clips 60. All of the assembly clips 60 are identical and are preferably a formed steel strap approximately ¾ inch (19 mm) wide and ⅛ inch (3.2 mm) in thickness. One end of the assembly clip 60 is formed at a right angle to define a stop 78 and the opposite end of the assembly clip 60 is formed into a hook or loop 80 extending at least 180 degrees and having a short, straight tail section 82 that extends generally parallel to the body of the assembly clip 60. The assembly clips 60 are arranged alternately such that, as illustrated in FIG. 4, the clips 60A on the right end of each of the first pair of sidewall assemblies 14 and the second pair of sidewall assemblies 16 are disposed slightly higher than the associated clips 60B disposed on the left end of each of the first pair of sidewall assemblies 14 and the second pair of sidewall assemblies 16. Thus, as illustrated in FIG. 4, the loops 80 of adjacent assembly clips 60A and 60B are vertically offset and are thus capable of vertical alignment.

When the first pair of sidewall assemblies 14 and the second pair of sidewall assemblies 16 are positioned along the inside edges of the longitudinal face plates 34 and the transverse end plates 38 of the pallet assembly 12, the loops 80 of adjacent clips 60A and 60B align such that a connecting pin or rod 90 may be positioned therein to secure the adjacent sidewalls together. The connecting pin or rod 90 is an elongate rod of suitable length which may define a tapered end 92 which facilitates installation and an upper terminal portion 94 which may be formed or bent at a right angle to the axis of the connecting pin or rod 90.

It will be appreciated that once the first pair of sidewall assemblies 14 and the second pair of sidewall assemblies 16 are positioned as illustrated in FIG. 1, the connecting rods 90 may be easily and quickly inserted into the adjacent hooks or loops 80 of adjacent assembly clips 60A and 60B thus connecting the pairs of sidewall assemblies 14 and 16 of the demountable palletized container 10. It will be also appreciated that the connecting pins or rods 90 may be as quickly removed by gripping the terminal portions 94 and pulling them vertically out of the clips 60A and 60B to disconnect the adjacent pairs of sidewall assemblies 14 and 16.

Figure 6:
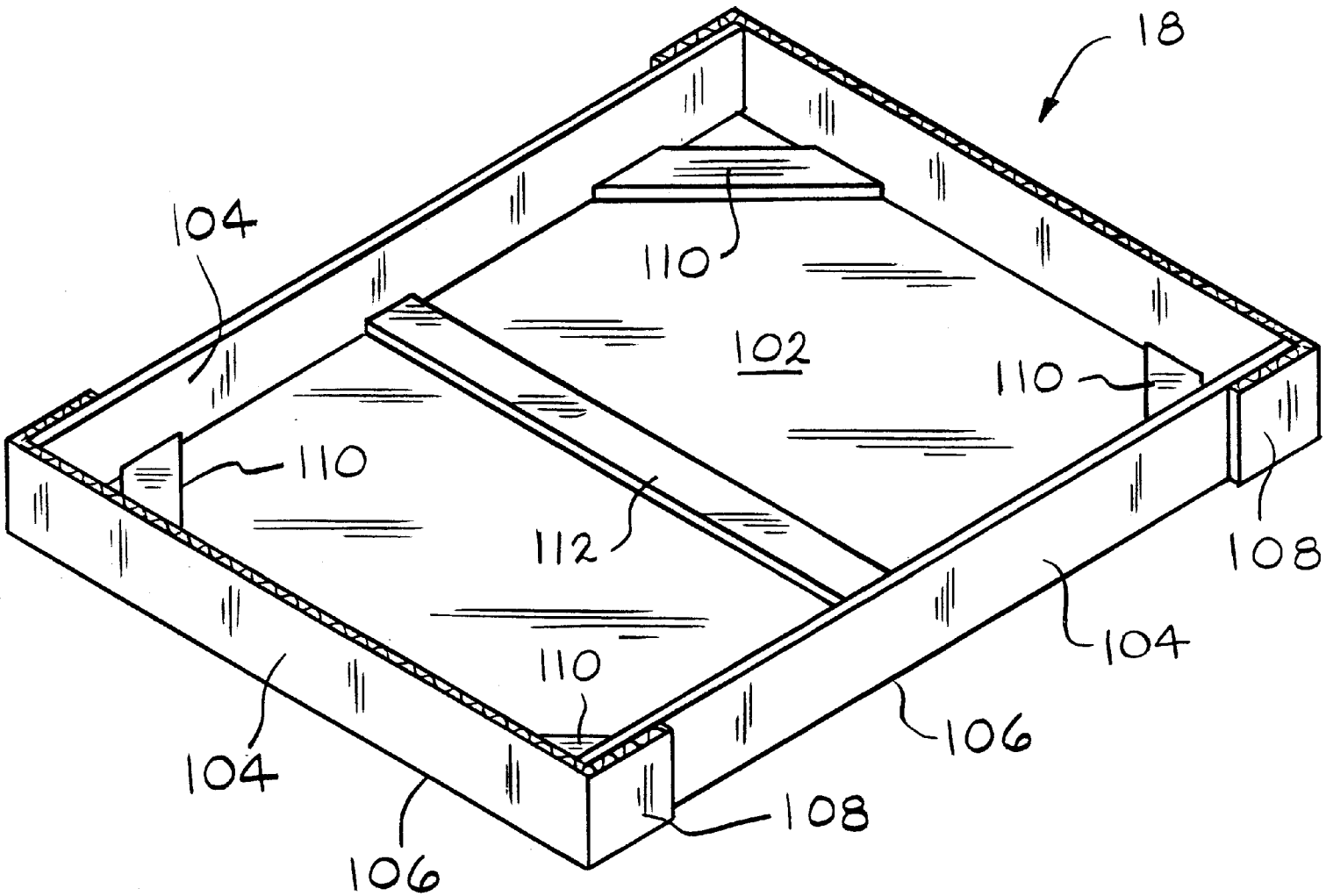
FIG. 6 is a perspective view of a top or cover tray of a demountable palletized container according to the present invention.

Referring now to FIGS. 1, 2 and 6, the top of the container 10 is relatively securely closed off by a snuggly fitting top or cover tray assembly 18. The top or cover tray assembly 18 includes a cardboard panel 102 having a lip or edge wall 104 formed along four fold lines 106. The lip or edge wall 104 is maintained in position by four overlapping tabs 108 which are secured to adjacent portions of the lip or edge wall 104 by staples, adhesive or other conventional cardboard fastening means. On the interior of the top or cover tray assembly 18 and obliquely oriented are four corner supports 110 which reinforce the corners of the cover tray assembly 18 and distribute the load of stacked pallets. A center brace or support 112 extends transversely across the cover tray assembly 18 and further reinforces it and assists in the distribution of vertical loads created by the placement of one or more pallets on the cover or tray assembly 18.

As to construction materials, the majority of the boards and panels are preferably a good grade of relatively light and strong wood such as white pine or similar wood or material having minimal knots and other irregularities which could compromise its strength. The transverse members 22, are, however, preferably a hardwood such as aspen or poplar. The cardboard panels such as the deck pad 42, the panel 58, the panel 72 and the panel 102 are preferably 275 pound corrugated cardboard. The pallet assembly 12 as well as the first and second pair of opposed sidewall assemblies 14 and 16 are preferably assembled with staples or nails.

Thus it will be appreciated that a palletized container 10 according to the present invention provides a readily assembleable and disassembleable container for parts, components and bulk material. The palletized container 10 utilizes a rugged pallet assembly 12 which functions as the base and receives the first pair of sidewall assemblies 14 and the second pair of sidewall assemblies 16 which include pairs of assembly clips 60 at each end. When installed as described in the pallet assembly 12, the hooks 80 of the assembly clips 60 align such that the connecting pins or rods 90 may be readily installed or inserted therein thereby connecting the adjacent ends of the pairs of sidewalls assemblies 14 and 16. The palletized container 10 may then be filled with bulk material, components, parts or other smaller containers for shipment and the cover assembly 18 disposed thereon, all as illustrated in FIG. 1. Upon arrival at its destination, this process may be reversed and the palletized assembly 10 may be disassembled into its planar components, the sidewall assemblies 14 and 16 and the cover assembly 18 positioned and stacked on the pallet assembly 12 and returned. Alternatively, a plurality of pallet assemblies 12 in similar pluralities of sidewall assemblies 14 and 16 and cover assembly 18 may be stacked in individual stacks as these components from a given size of palletized container 10 will be of the same size and thus readily stacked and returned to their point of origin.

The foregoing disclosure is the best mode devised by the inventors for practicing this invention. It is apparent, however, that apparatus incorporating modifications and variations will be obvious to one skilled in the art of reuseable packaging. Inasmuch as the foregoing disclosure presents the best mode contemplated by the inventors for carrying out the invention and is intended to enable any person skilled in the pertinent art to practice this invention, it should not be construed to be limited thereby but should be construed to include such aforementioned obvious variations and be limited only by the spirit and scope of the following claims.

We claim:

1. A demountable palletized container comprising, in combination, a pallet including a plurality of longitudinal members secured to a plurality of transverse members, said pluralities of members defining a periphery, a plurality of edge defining members secured about said periphery and defining an edge above said pluralities of members, a first pair of opposed sidewalls having a pair of spaced apart upright members and a pair of horizontal members defining a lower longitudinal edge, said pair of upright members extending beyond said lower longitudinal edge, a second pair of opposed sidewall members having a pair of spaced apart upright members and a pair of spaced apart horizontal members defining a lower longitudinal edge, said first pair of opposed sidewalls and said second pair of opposed sidewalls defining four corners, demountable corner assemblies disposed at each of said four corners, said demountable corner assemblies including a plurality of hook members extending from said pairs of sidewalls and a plurality of connecting rods for disposition in said hook members, and a cover sized to fit upon said opposed pairs of sidewalls when said sidewalls are disposed on said pallet.

2. The demountable palletized container of claim 1 wherein said demountable corner assemblies includes a plurality of metal clips extending from said pairs of upright members, each of said metal clips including an end adapted to receive a connecting rod.

3. The demountable palletized container of claim 1 further including panels secured to said upright members.

4. The demountable palletized container of claim 1 wherein said cover includes corner braces and a center brace extending across said cover.

5. The demountable palletized container of claim 1 further including skid blocks secured to said transverse members.

6. The demountable palletized container of claim 1 wherein each of said demountable corner assemblies includes one of said plurality of connecting rods and said upright members each includes a pair of grooves for receiving a portion of a respective pair of said hook members.

7. A demountable palletized container comprising, in combination, a pallet including a first plurality of members secured to a second plurality of perpendicularly oriented members, said second plurality of members defining a reference plane, a first pair of edge members disposed parallel to said first plurality of members, a second pair of edge members disposed parallel to said second plurality of members, said pairs of edge members defining an upper edge above said reference plane, a first pair of spaced apart sidewalls having a pair of spaced apart vertical members and a pair of spaced apart horizontal members, one of each of said pair of horizontal members defining a lower horizontal edge, said upright members extending beyond said lower horizontal edge, a second pair of spaced apart sidewall members disposed normal to said first pair of spaced apart sidewalls having a pair of spaced apart vertical members and a pair of spaced apart horizontal members secured thereto, a plurality of assembly clips extending outwardly from said vertical members, said clips including ends adapted to receive a retaining rod, and a retaining rod adapted to be received within adjacent overlapping assembly clips at each corner of said pallet whereby said opposed pairs of sidewalls may be assembled to and disassembled from one another by insertion and removal of said metal rods.

8. The demountable palletized container of claim 7 further including panels secured to said vertical members.

9. The demountable palletized container of claim 7 further including a cover, said cover including corner braces and a center brace extending across said cover.

10. The demountable palletized container of claim 7 wherein said assembly clips have a first hooked end and a second end formed at a right angle.

11. The demountable palletized container of claim 7 further including skid blocks secured to said transverse members.

12. The demountable palletized container of claim 7 further including a cardboard panel disposed on said reference plane.

13. The demountable palletized container of claim 7 wherein said second plurality of members and said second pair of edge members define slots.

14. A demountable palletized container comprising, in combination, a pallet including a first plurality of spaced-apart members disposed above and at right angles to a second plurality of spaced-apart members, said first plurality of members defining a surface, a plurality of edge members secured to said first plurality of members and said second plurality of members, said edge members having an upper edge disposed above said surface, four sidewalls disposed in opposed, parallel pairs, each of said sidewalls having a pair of spaced-apart upright members and a pair of spaced-apart horizontal members secured to said pair of upright members and defining ends, said four sidewalls disposed at right angles to adjacent sidewalls and demountable connector assemblies disposed at each of said corners including hook members extending from said horizontal members and upright pins disposed at each of said corners for engaging said hook members.

15. The demountable palletized container of claim 1 wherein said upright members define grooves and said hook members are disposed in said grooves.

16. The demountable palletized container of claim 14 further including panels secured to said upright member.

17. The demountable palletized container of claim 14 further including a cover, said cover including corner braces and a center brace extending across said cover.

18. A demountable palletized container comprising, in combination, a pallet including a plurality of longitudinal members secured to a plurality of transverse members defining a periphery, one of said plurality of longitudinal or transverse members defining an upper surface, a plurality of edge defining members secured about said periphery of said pallet defining an upper edge above said upper surface, a first pair of opposed sidewalls each having a pair of spaced apart upright members and a pair of horizontal members defining a lower longitudinal edge, said upright members extending beyond said lower longitudinal edge, a second pair of opposed sidewalls each having a pair of spaced apart upright members and a pair of spaced apart horizontal members secured thereto, said first pair of opposed sidewalls and said second pair of opposed sidewalls arranged to define four corners, and connector assemblies including hook members and an upright connector pin disposed at each of said four corners for selectively coupling and releasing said pairs of sidewalls, said hook members disposed for engagement by said upright connector pin.

19. The demountable palletized container of claim 18 wherein said hook members extend from said horizontal members and connector pins are elongate and engage said hook members disposed at each of said four corners.

20. The demountable palletized container of claim 18 wherein said upright members define grooves and said hook members are disposed in said grooves.

21. The demountable palletized container of claim 18 further including panels secured to said upright members.

22. The demountable palletized container of claim 18 further including a cover, said cover including corner braces and a center brace extending across said cover.

* * * * *